United States Patent [19]

Becker et al.

[11] Patent Number: 4,662,280

[45] Date of Patent: May 5, 1987

[54] EXPLOSIVE AND INCENDIARY PROJECTILE

[75] Inventors: Wilfried Becker, Duesseldorf; Bernhard Bisping, Ratingen, both of Fed. Rep. of Germany

[73] Assignee: Rheinmetal GmbH, Duesseldorf, Fed. Rep. of Germany

[21] Appl. No.: 718,084

[22] Filed: Apr. 1, 1985

Related U.S. Application Data

[63] Continuation-in-part of Ser. No. 570,216, Jan. 12, 1984, abandoned.

[30] Foreign Application Priority Data

Jan. 18, 1983 [DE] Fed. Rep. of Germany ..... 3301381

[51] Int. Cl.[4] ..... F42B 11/24; F42B 13/14

[52] U.S. Cl. ..... 102/364; 102/517; 102/518

[58] Field of Search ..... 102/517–519, 102/364

[56] References Cited

U.S. PATENT DOCUMENTS

| | | | |
|---|---|---|---|
| 2,401,483 | 6/1946 | Hensel et al. | 102/519 |
| 3,302,570 | 2/1967 | Marguardt | 102/364 |
| 3,518,942 | 7/1970 | Philipchuk | 102/473 |
| 3,599,573 | 8/1971 | Sliney | 102/517 |
| 3,677,182 | 7/1972 | Peterson | 102/364 X |
| 3,941,057 | 3/1976 | Peterson et al. | 102/364 |
| 3,979,234 | 9/1976 | Northcutt et al. | 419/28 |
| 4,167,140 | 9/1979 | Biseröd | 102/364 X |
| 4,237,787 | 12/1980 | Wacula et al. | 102/517 X |
| 4,353,302 | 10/1982 | Strandli et al. | 102/364 |
| 4,384,528 | 5/1983 | Moore et al. | 102/519 X |
| 4,437,409 | 3/1984 | Freymond | 102/364 |
| 4,444,112 | 4/1984 | Strandli et al. | 102/518 X |
| 4,458,599 | 7/1984 | Mullendore et al. | 102/517 |

FOREIGN PATENT DOCUMENTS

| | | |
|---|---|---|
| 554538 | 6/1932 | Fed. Rep. of Germany . |
| 1952494 | 4/1971 | Fed. Rep. of Germany . |
| 9611932 | 5/1950 | France . |
| 8049 | 2/1894 | Switzerland . |
| 2021739 | 5/1979 | United Kingdom . |

*Primary Examiner*—David H. Brown

[57] ABSTRACT

An improved explosive and incendiary full caliber projectile having a high splinter effect. The projectile produces a reliable incendiary effect at impact by releasing splinters from the casing. It is of simple construction and the casing and splinters have a high penetration capability in particular when the projectile is less than 40 mm in caliber.

At least a preponderantly longitudinal portion of the casing is made of a homogeneous substance consisting of a heavy metal alloy having a density in excess of 17 g/cm$^3$. By using a sintered high tungsten content casing a relatively larger volume of an explosive charge can be used which enhances the penetration capability and splinter swarm producing effect of the projectile at impact.

6 Claims, 6 Drawing Figures

EXPLOSIVE AND INCENDIARY PROJECTILE

CROSS-REFERENCE TO RELATED APPLICATION

This application is a continuation-in-part application of our copending application Ser. No. 570,216, filed on Jan. 12, 1984 and now abandoned.

BACKGROUND OF THE INVENTION

A projectile is known and described in German published Patent Application No. DE-OS 25 57 676 which projectile body has a casing which is made up of a plurality of projectile heavy metal splinters, for example depleted uranium. Such a projectile made of steel, is for example, disclosed in Rheinmetall Taschenbuch, 1980 Edition, pg. 471, FIG. 1106. A casing made of heavy metal splinters is described in German published application DE-OS 255 7676. The splinters are embedded in a carrier substance of the casing and cause in addition to a pyrophoric effect at impacting of the splinters on a combustible substance also the mechanical effect of the uranium which is also useful at impact. Such a projectile is fabricated with a complex and costly manufacturing process. The casing consists of an inner and outer tubular body of the same material, whereby the projectile splinters, which are embedded in the carrier material, consist of a material having a substantially higher density. In order to give such a projectile a sufficient firing strength it is necessary for the projectile body to have a sufficiently wide cross-section. However, this makes it impossible to substantially increase the average specific weight of the projectile casing. It has been found to be particularly disadvantageous in this known projectile that the amount of projectile splinters, consisting of an effective depleted uranium embedded into the carrier substance, is limited as a result of having to maintain a sufficient minimum firing strength. Consequently, the effect of the projectile and the splinters on the target becomes inadequate, in particular a full caliber explosive and incendiary projectile of less than 40 mm caliber because such projectile can only be maintained either by using dimensionally small embedded splinters or by a projectile casing being too thick. At detonation there form, preponderantly by the inner and outer cylindrical bodies of the projectile, projectile splinters of a reduced penetration capability, whereby the lighter produced splinters of the projectile casing can, on the one hand, not achieve a pyrophoric (incendiary) effect and, on the other hand, the incendiary effect on the target is significantly reduced.

SUMMARY OF THE INVENTION

It is an object of this invention to simplify the construction of the projectile of this invention in comparison to the known projectile of the same type. The projectile of the invention is designed to provide a reliable incendiary effect at impact by means of splinters of pyrophoric material that are released from the cross-section of the projectile casing. Such novel full-caliber explosive and incendiary projectile can attain a high penetration capability when the caliber range is equal or less than 40 mm by calibrating the projectile proper; the projectile casing of this novel projectile fragments explosively and with improved incendiary effect.

The projectile of the invention, when compared to the projectile of German published application DE-OS 25 57 676 can be made of a relatively thin wall construction considering that it is a full caliber explosive and incendiary projectile, wherein the projectile casing has comparatively the same mass and the same wall thickness, as a result of the homogeneity and high density of the material that is being used. The wall thicknesses of the above described state of the art projectiles is such that the wall thickness is at least 15% of the projectile diameter. In the projectile of this invention the wall, which consists primarily of tungsten has a wall thickness ranging from 5% to 15% of the caliber diameter. The projectiles of this invention have an axial length to caliber diameter ratio L/D 6 to 10 which gives them improved flight stability. In contradistinction thereto, the conventional spin-stabilized explosive projectiles having a steel casing and having a conventional spin angle in a rifled bore of 6 to 8 degrees can only obtain an adequate flight stability with a ratio $L/D<6$. The increased flight stability is attained by virtue of increasing the specific weight of the entire homogeneous projectile casing. This specific weight increase is caused by a tungsten to steel ratio larger than 2.2. By the thereby resulting advantageous enlargement of the available space for accommodating the explosive charge there is achieved not only a comparatively high gas pressure, but also the projectile casing splinters are accelerated with a higher energy. As a result of the projectile casing being homogeneous and made out of a sintered heavy metal alloy having a density larger than 17 $gm/cm^3$, there results in addition to a very simple construction for the projectile casing a particularly effective and high splinter effect over the entire cross-section of the projectile casing. By the formation of so-called splinter clouds or splinters swarms there is achieved a cumulative splinter effect.

Further advantages are achieved by comparing the splinters of the projectile of this invention with splinters made out of steel of the same mass and velocity. For example in flight, as a result of the reduced air resistance, there is achieved a lowering of the velocity decrease as well as a result of the high cross-sectional loading i.e. weight/surface of the splinters there is achieved a penetration capability which is higher by several orders of magnitude. Thereby, upon impacting of the projectile on combustible material, for example a multi-plated aluminum target, which is conventionally used for airplanes, helicopters, etc. the larger splinters, which precede the main splinter dust swarm or cloud, achieve a high penetration capability with incendiary effect and by means of the glow effect of the following smaller splinters a reliable incendiary effect is achieved.

By means of the particularly favorable splinter and incendiary formation, as is achieved with the projectile casing of this invention over most of the longitudinal region a of the projectile casing, made out of a homogeneous material of a sintered heavy metal alloy having at least 85% and maximum 98% of a tungsten content, even sealed tanks can be put on fire in a reliable manner.

DESCRIPTION OF THE DRAWINGS

With these and other objects in view, which will become apparent in the following detailed description, the present invention, which is shown by example only, will be clearly understood in connection with the accompanying drawing, in which.

DETAILED DESCRIPTION

Figure 1:
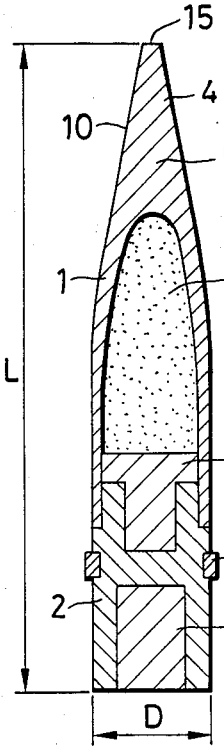
FIG. 1 is a schematic longitudinal sectional view of a full caliber explosive and incendiary projectile having a massive nose point construction.
Figure 6:
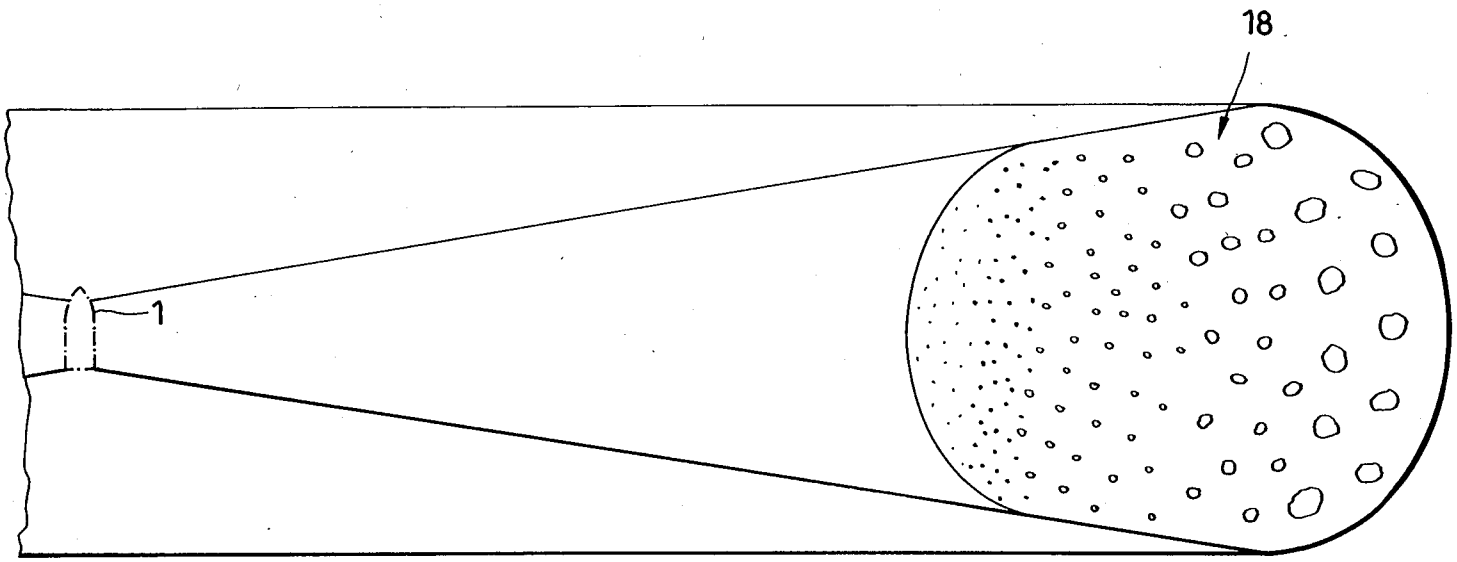
FIG. 6 illustrates the swarms of projectile splinters formed when the projectile casing explodes.

The projectile of FIG. 1 includes an upper casing portion 1 which is shaped as a ballistic hood of a full caliber explosive and incendiary projectile and holds in the interior hollow space thereof an explosive charge 3. A tail portion 2 of the projectile is inserted from the rear into the front portion 1. The tail portion 2 has a lateral guide ring 9 mounted thereon and also includes an adjustable impact bottom ignition fuse 16 as well as a tracer composition body 17. A propellant charge casing is connected to the rear of the projectile in a conventional but non-illustrated manner (this also applies to the projectiles of FIGS. 2 and 3). The projectile nose 4 is constructed as part of the projectile casing 1 and has a nose point 15 which forms the blunt apex of a rearwardly extending conically shaped hood 10. The entire projectile casing, including the portion 5 which is disposed between the conically shaped hood 10 and the explosive charge 3, consists, in accordance with the invention, of a homogeneous substance made of a sintered heavy metal alloy having a density higher than 17 g/cm$^3$. A heavy metal alloy consisting of 85% to 98% tungsten, with additions of iron, cobalt and nickel, has been found to be particularly suitable as a substance offering a high penetration capability against lightly armored targets and for a secure burning effect formation at impact on a combustible substance. As a result of the reduced volume of heavy metal alloy present in the casing it has been ascertained that a thin wall projectile casing 1 is possible and capable of receiving a large amount (volume) of an explosive charge 3, whereby high gas pressure is formed and the entire mass of projectile splinter 18 of the projectile casing 1, consisting of a tungsten alloy, are accelerated in such a way that, as a result of their kinetic energy, they achieve in addition to a high penetration at impact on combustible substances a large amount of splinters (FIG. 6) all of which are capable of causing an incendiary effect.

Figure 2:
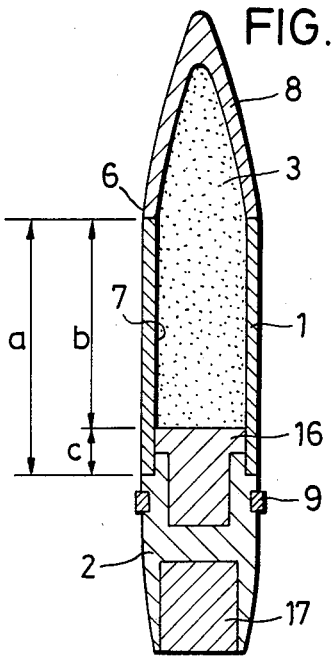
FIG. 2 is a schematic longitudinal sectional view of a full caliber explosive and incendiary projectile forming an alternate embodiment of the invention which has a casing that is made out of a heavy metal alloy over substantially most of its longitudinal extent.
Figure 4:
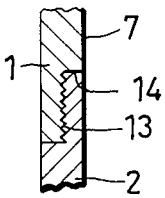
FIGS. 4 and 5 illustrate in cross-section constructional details of the respective rear ends of the cylindrically longitudinal region a of the projectile casing 1 illustrated in FIG. 2.
Figure 5:
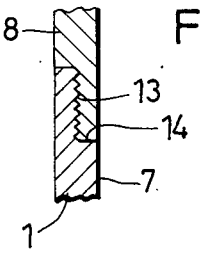

There is illustrated in FIG. 2 a full caliber explosive and incendiary projectile extending longitudinally over most of the longitudinal region a of the projectile casing 1 which casing consists of a homogeneous substance of a heavy metal alloy as described in conjunction with the embodiment of FIG. 1. In this projectile the nose portion 8 of the projectile casing 1 is made of a different wall thickness than the remainder of the casing and is made of a substance of lower density than that of the remainder of the casing. Thereby the longitudinal region a of the projectile casing 1 over a partial region b surrounds the explosive charge 3 and the projectile casing forward portion 8 is hollow. This enables this type of projectile to receive a particularly large amount of explosive charge 3. The projectile of FIG. 2 has a projectile rear portion 2, similar to the projectile rear portion 2 of FIG. 1, in which a guide ring 9 is mounted as well as an adjustable bottom impact ignition fuse 16 and a tracer composition 17, whereby the projectile casing 1 and the projectile lower portion 2 are joined in a partial region c so that the projectile casing 1 is disposed in front of the guide ring 9. The longitudinal region a of the projectile casing 1 is preponderantly pipe-shaped up to the ogive 6 of the projectile casing 1, whereby the ends 7 of casing 1 are joined to the adjoining respective portions 2 and 8 as shown in FIGS. 4 and 5 by means of recesses 14 in which mating threaded portions 13 meshingly engage each other to act as connecting means between the projectile rear portion 2 and ogive 8, on the one hand, and the projectile casing 1, on the other hand.

The explosive and incendiary projectile is, as a result of the homogeneous and sintered substance of high density used in the preponderantly pipe-shaped projectile casing 1, capable of penetrate lightly armored targets, whereby the subsequently effective projectile splinters which penetrate into the interior of the target are suitable to destroy encapsulated instruments and cause an incendiary effect as has been described in conjunction with the embodiment of FIG. 1.

Figure 3:
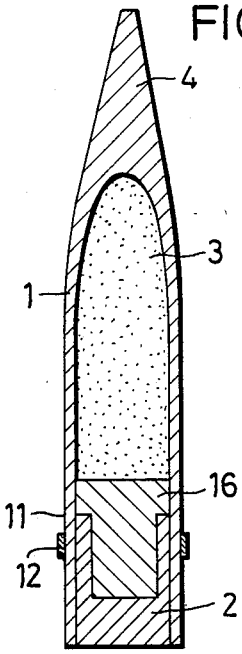
FIG. 3 is a schematic longitudinal sectional view of a full caliber explosive and incendiary projectile forming another alternate embodiment of the invention, the projectile casing of which surrounds laterally the entire lower projectile region.

In a further embodiment of the invention which corresponds insofar as the front portion is concerned to the projectile of FIG. 1, the casing extends rearwardly so as to encompass completely the projectile lower body 2 laterally. This embodiment of the projectile is illustrated in FIG. 3. The guide ring 12 is mounted laterally in a non-detachable manner by means of a heat treatment, in particular by means of a welding or soldering on the exterior surface 11 of the projectile confronting its rear region 2. As a result of this explosive and incendiary projectile having an adjustable bottom ignition impact fuse 16 but no tracer composition body, this variation of the projectile, as compared to the projectile of FIG. 1, has a higher explosive charge capacity for the explosive charge 3. This projectile is suitable in particular for combatting laterally armored targets, whereby the armor-piercing is produced by the kinetic energy of the nose point 4 of the projectile. The extending length of the projectile casing 1 contributes thereby to a high degree of splinter and incendiary effects.

Athough a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved explosive and incendiary full caliber projectile having a thin-walled casing which encompasses in hood-like fashion an explosive charge and which has a rearwardly facing open end which is operatively coupled to a rear projectile portion, which closes said open end, the improvement comprising said casing having a nose portion and a cylindrically shaped portion extending rearwardly therefrom over an axial length a, the wall thickness of said cylindrical portion being 5% to 15% of the caliber diameter of said projectile and the material forming said casing having a specific density larger than 17 g/cm$^3$ and consisting of a homogeneous sintered heavy metal alloy having a tungsten content of 85% to 98%, whereby a sufficiently strong casing is formed so that at target impact the projectile casing disintegrates into a swarm of splinters as a result of the relatively large explosive charge which accelerate radially with high velocity and penetration capability which produce a leading large splinter swarm and a trailing small splinter swarm causing an incendiary effect.

2. The improved explosive and incendiary projectile as set forth in claim 1, wherein said homogeneous substance of the sintered heavy metal alloy forming said longitudinal extent of said casing includes additions of metal selected from the group of metals iron, cobalt and nickel.

3. The improved explosive and incendiary projectile as set forth in claim 2, includng the rear projectile portion connected to said open rear end wherein said longitudinal extent a of said casing includes a partial front portion b in which the explosive charge is disposed and a partial rear portion c which is connected to said rear projectile portion.

4. The improved explosive and incendiary projectile as set forth in claim 3, wherein said front portion of said casing is ogival in shape and extends rearwardly up to said longitudinal extent of said casing, said longitudinal extent of said casing being cylindrically shaped, the rear end of said longitudinal extent of said casing being threadably connected to said rear projectile portion and the front end of said longitudinal extent of said casing being threadably connected to said front portion of said casing.

5. The improved explosive and incendiary projectile as set forth in claim 3, wherein said longitudinal extent a of said casing completely surrounds said rear projectile portion, and a guide ring is non-detachably mounted on said casing so as to confront said rear projectile portion.

6. The improved explosive and incendiary projectile as set forth in claim 5, wherein said projectile casing includes a solid nose portion having a conical shape which is disposed in front of said longitudinal extent of said casing and extends rearwardly up to the explosive charge; said nose portion consisting of a homogeneous substance of a sintered heavy metal alloy having a density greater than 17 g/cm$^3$.

* * * * *